US005494366A

United States Patent [19]

Pell et al.

[11] Patent Number: 5,494,366

[45] Date of Patent: Feb. 27, 1996

[54] ORGANIZER NOTEBOOK

[76] Inventors: Herbert C. Pell; Eugenia S. D. Pell, both of 6210 E. Cholla Pl., Paradise Valley, Ariz. 85253

[21] Appl. No.: 248,196

[22] Filed: May 24, 1994

[51] Int. Cl.[6] ..... B42D 1/00

[52] U.S. Cl. ..... 402/73; 281/15.1; 281/29; 281/31

[58] Field of Search ..... 281/22, 15.1, 29, 281/31, 51; 402/3, 80 R, 80 P, 70, 73

[56] References Cited

U.S. PATENT DOCUMENTS

| | | | |
|---|---|---|---|
| 4,515,493 | 5/1985 | Radovich | 402/70 X |
| 4,736,853 | 4/1988 | O'Mara . | |
| 5,069,567 | 12/1991 | Fink et al. | 402/3 |

FOREIGN PATENT DOCUMENTS

| | | | |
|---|---|---|---|
| 483032 | 4/1992 | European Pat. Off. | 402/70 |
| 2586617 | 3/1987 | France | 402/75 |

*Primary Examiner*—Frances Han
*Attorney, Agent, or Firm*—Gregory J. Nelson

[57] ABSTRACT

An organizer notebook having front and rear covers hingedly secured to one another. The inner face of one of the covers has pockets for receipt and retention of personal items such as pens, pencils and the like. The inner surface of the other cover has document retention means in the form of a pair of opposed flaps foldably secured to the cover beneath which papers and other documents can be placed in an organized manner. The flaps are securable to one another by a closure.

11 Claims, 1 Drawing Sheet

ORGANIZER NOTEBOOK

BACKGROUND OF THE INVENTION

1. Field of the Invention

The present invention relates to an organizer notebook and more particularly relates to an organizer notebook for the containment of personal items and includes a retaining arrangement for papers, folders or notebooks.

2. Description of Related Art

It is common for persons to use organizers or notebooks of various types to maintain and store items such as pencils, calculators, papers and appointment books in an organized fashion. Various types of such organizers can be found in the prior art. One of the most common is the simple three ring binder in which loose leaf paper is inserted. Other more elaborate cases or organizers can be found. One popular type of organizer in common use is sold under the trademark "DayTimer" organizer.

The patent literature shows other various types of organizers or pocket secretaries. For example, U.S. Pat. No. 4,296,945 shows a pocket secretary having pockets and a bracket for detachably mounting a notebook.

U.S. Pat. No. 4,470,620 shows a document holder for a writing pad, papers and accessories. The holder has covers and a leaf member hingedly positioned between the covers which may be used as a writing or organizing surface.

U.S. Pat. No. 4,519,629 shows a spiral notebook and folder construction formed from a single blank of sheet material. A pocket is provided on the inner surface of the front cover panel which opens outwardly.

U.S. Pat. No. 4,555,018 discloses a carrier for pencils particularly a folder type portable pencil case that may be carried separately or attached to a book or notebook.

U.S. Pat. No. 4,630,843 shows a binder for holding papers having an exterior cover sheet and an overlying interior cover sheet which is foldable to define a rigid panel separated by at least one flexible hinged panel. Pockets or sleeves may be included to hold writing instruments. A pocket sheet which may be translucent overlies the interior cover sheet.

U.S. Pat. No. 4,736,853 shows a flexible, magnetized holder with pockets for accessories such as pens, tissues and the like.

U.S. Pat. No. 4,964,508 discloses a holder for keys or other items which holder has a pocket. The holder is adhesively securable to a surface so that it may be hidden for emergency use.

U.S. Pat. No. 4,964,656 shows a folder having a central panel and two side panels. The side panels have pockets to receive cards to assist telephone solicitors.

From the foregoing, it will be seen that there are a wide variety of notebooks, document holders, pocket secretaries and organizers for storing and retaining papers and other personal items. Many of the prior art notebooks or organizers include provision for the retainment of paper and documents. In most cases, the paper must be specially adapted to cooperate with a notebook. For example, it is common that the paper must be punched at specific locations to be accommodated in a binder or rings of an organizer.

The present invention provides a simplified organizer for use by students, business persons and for personal use which is convenient and which organizer has provision for the containment of various personal items. In addition, the organizer has retainers for securing papers in place. The papers may be variously sized and may be loose papers or papers maintained in a sheath or folder such as a composition book. No special papers or inserts are required.

SUMMARY OF THE INVENTION

Briefly, the present invention relates to an organizer notebook having front and rear covers joined along a binder. The interior of one of the covers is provided with pockets and sleeves on an interior surface for receiving and storing various personal items such as pencils, pens, calculators, currency and the like. The opposite interior cover provides a surface for the placement and retention of papers which may be loose papers or papers contained in folders, sheaths, notebooks and the like. The papers are retained in place by opposite foldable flaps having cooperating closures. The entire organizer may also be closed by cooperating closures. The closures are preferably loop and hook type closures of the type sold under the trademark "Velcro". The notebook may be constructed of any suitable material such as plastic or fabric and may include suitable reinforcing panels to add rigidity to the covers.

BRIEF DESCRIPTION OF THE DRAWING

The above and other objects and advantages of the present invention will be more fully appreciated from the following detailed specification, claims and drawings in which:

DESCRIPTION OF THE PREFERRED EMBODIMENTS

Figure 1:
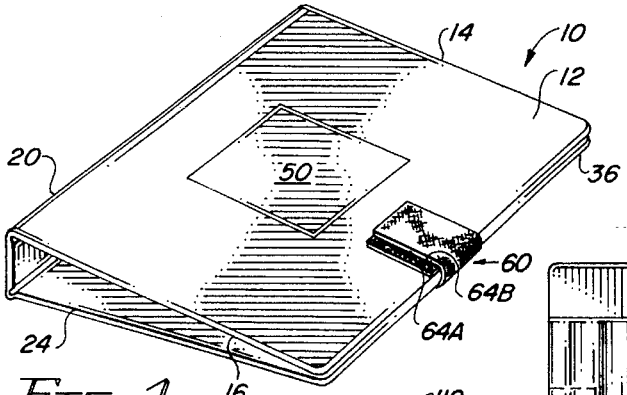
FIG. 1 is a perspective view of the organizer notebook of the present invention shown in the closed position.

Turning to the drawings, the organizer notebook of the present invention is generally designated by the numeral 10 and includes a front cover 12 having top edge 14, lower edge 16, front edge 18 and rear edge 20. Rear edge 20 is foldably or hingedly connected to a binder or backing section 22. A rear cover 24 is hingedly or foldably connected to the binder section 22 along fold line 28 at edge 30. The rear cover also has top edge 32, bottom edge 34 and front edge 36.

Figure 5:
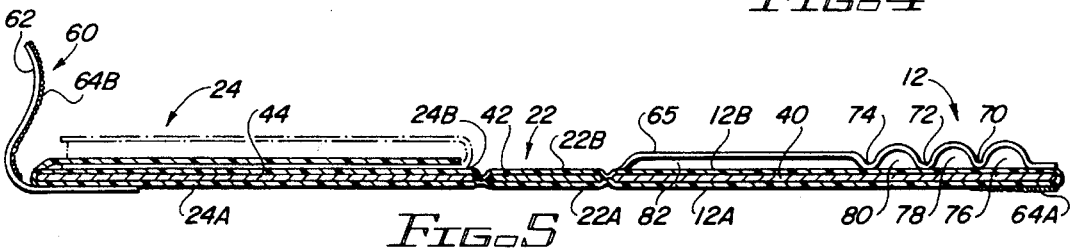
FIG. 5 is a sectional view taken along line 5—5 of FIG. 2.

As best seen in FIG. 5, the covers and binder may be formed from any suitable flexible material such as fabric or plastic. Preferably the covers and binder are formed from a front cover having an outer surface 12A and an inner surface 12B. Similarly, the back cover has an outer surface 24A and an inner surface 24B.

Binder section 22 has an inner surface 22B and an outer surface 22A. The outer and inner surfaces are formed by a ply of material and are separated by a rigid or semi-rigid insert. For example, insert 40 is positioned between the inner and outer surface of the cover 12. Similarly, inserts 42 and 44 are positioned between the opposite surfaces of the binder and the back cover. The inserts are typically a sheet of plastic or other rigid material such as cardboard which, as indicated, provides some rigidity to the structure. The front cover may be decorated with any suitable indicia 50 such as graphic design or letters of insignia representative of a school, club or organization.

When the organizer notebook 10 is in a folded position as shown in FIG. 1, the front and rear covers are juxtaposed with respect to one another with the covers folded relative to the binder or hinge section along fold lines 28 and 28A. A suitable closure assembly 60 is provided to maintain the organizer notebook in a closed position. The closure 60 is shown as a fabric closure having tab 62 secured adhesively or by stitching to surface 24A at an intermediate location along the outer edge. The tab has sufficient length to overly the surface 12A of the front cover. The front cover 12A is provided with one section 64A of a hook and loop fabric fastener. The other section 64B of the cooperating fastener sections is secured to a surface of tab 62. Thus, in the closed position, the tab can be secured to the cover 12A by engaging sections 64A and 64B as shown in FIG. 1.

Figure 3:
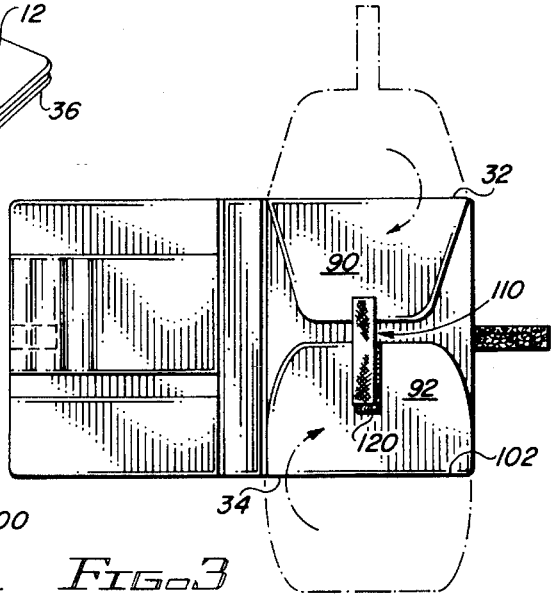
FIG. 3 is a view similar to FIG. 2 with the retention flaps in a closed position and the notebook organizer in an open position.
Figure 2:
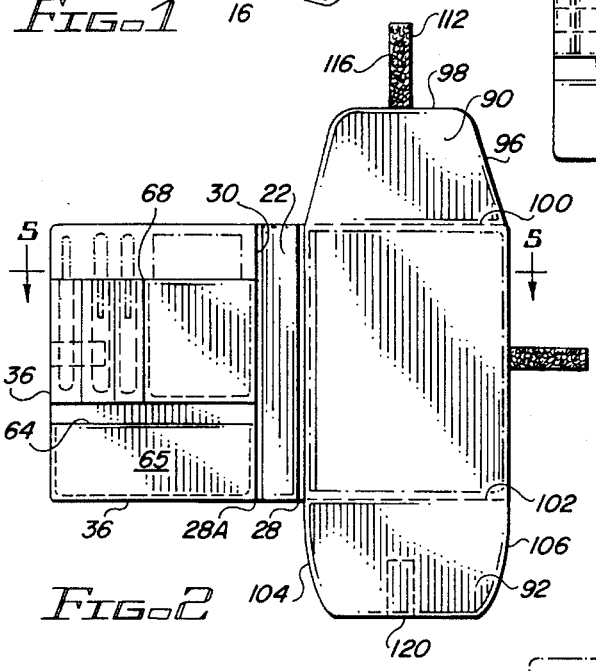
FIG. 2 is a plan view of the organizer notebook of the present invention shown in an open position with various stored personal items indicated by dotted lines.
Figure 4:
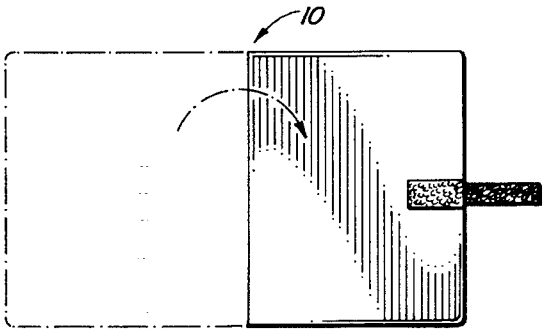
FIG. 4 is a plan view showing the covers of the notebook moved from an open to a closed position.

FIGS. 2 and 3 illustrate the organizer notebook of the present invention in an open position. As seen, the inner side of cover 12 defines a number of pockets or sleeves for containment of various items. Accordingly, a panel 65 of fabric or plastic material is secured to the inner face 12B of the cover. The panel 65 is secured to the cover along its opposite side edges 30 and 36 and also along its bottom edge 34. A zipper or other closure 64, such as a loop and hook fabric closure, extends transversely in the panel providing access to pocket 65 along the lower edge of the inside cover. The upper edge of the panel terminates at horizontal edge 68 which extends transversely across the inner side of the front cover. As best seen in FIG. 5, this panel is secured to the inner side of the cover at a plurality of locations 70, 72 and 74. The panel may be attached by appropriate stitching, by adhesive or in the event the material is a plastic material, by suitable bonding by a dielectric or other method. Accordingly, a plurality of sleeves or pockets 76, 78, 80 and 82 are provided which are open at their upper end. Various items such as pens, pencils, calculators and other personal accessories may be inserted into these pockets for convenient storage and easy access.

The opposite inside cover 24B is provided with means for retaining documents such as loose papers, notebooks, composition books and the like. As has been mentioned above, conventional organizers and notebooks normally have a ring arrangement or some mechanical clip arrangement that often requires the paper or documents retained to be specially adapted to cooperate with the rings or binders. With the present invention, loose papers or documents of various size can be conveniently contained against surface 24B. To this end, a pair of retention flaps 90 and 92 are provided. Flap 90 has inwardly tapered, opposite edges 94 and 96, bottom edge 98 and an upper edge 100. Upper edge 100 is foldably secured to the upper edge of the back cover. The bottom edge extends to an intermediate location along the back cover when in the position shown in FIG. 3.

Flap 92 is similarly constructed being foldably secured to the lower edge of the inside 24B back cover along transverse fold line 102. Opposite side edges 104 and 106 taper inwardly slightly and terminate at upper edge 106 which when closed, as seen in FIG. 3, is located at an intermediate location along the inside of the cover.

The flaps are securable by closure member 110 includes a flap 112 having material strip 116 on the inner surface. The strip 116 cooperates with closure member 120 located on the outer surface of the lower flap. The closure may be a mechanical closure such as a snap or preferably is a hook and loop fabric closure member.

In use, various personal items such as pencils, calculators and the like, may be placed in the various pockets 76, 78, 80 and 82. Pocket 65 will receive loose items and items such as identification cards and currency. Papers such as composition folders or loose papers may be placed against the inside surface 24B of the back cover 24 and retained in place by folding the upper flap 90 downwardly and the lower flap 92 upwardly and securing the flaps at closure member 110. Papers are retained against dislodgement by the flaps and by the binder and the closure member 60 extending from the back to the front cover. When access to the papers contained within the organizer is desired, the closure 60 is opened as well as closure 110. The papers may be easily removed or inserted as desired. The papers of various sizes may be in folders or loosely inserted without using rings or clips. The papers may be easily arranged and organized in the retention area beneath the flaps.

Thus, it will be seen from the foregoing that the present invention provides an organizer notebook that is easy to manufacture, inexpensive and efficient. The organizer notebook may be made of various materials and may be imprinted with suitable indicia or design. The folder can be made in various sizes but preferably the front and back covers will be consistent with standard notebook sizes being approximately 10"×12" each.

It will be obvious to those skilled in the art to make various changes, alterations and modifications to the organizer notebook invention described herein. To the extent these various alterations, modifications and changes do not depart from the spirit and scope of the appended claims. They are intended to be encompassed therein.

We claim:

1. A notebook organizer comprising:

(a) a front cover having top, bottom and opposite side edges and having inner and outer surfaces;

(b) a back cover having top, bottom and opposite sides and having inner and outer surfaces, said front and back covers being foldably joined relative to one another at selected edges of said front and back cover;

(c) article retaining means located on the inside of one of said covers;

(d) document retention means located on the inside of the other of said covers, said document retaining means comprising a pair of flaps oppositely disposed and each being hingedly connected to said other cover; and (e) closure means for selectively securing said flaps together in a retention position overlying said cover to secure documents between said flaps and said other cover.

2. The organizer notebook of claim 1 further including closure means for securing said front and rear covers together.

3. The organizer notebook of claim 1 further including a binder interposed between the edges of said front and rear cover and wherein said covers are foldable relative to said binder.

4. The organizer notebook of claim 1 wherein said organizer notebook is of fabric.

5. The organizer notebook of claim 1 wherein said organizer notebook is fabricated of plastic.

6. The organizer notebook of claim 1 wherein said organizer notebook is fabricated from a flexible material and includes a rigid insert.

7. The organizer notebook of claim 1 wherein at least one of the outer surfaces of said cover is provided with indicia.

8. The organizer notebook of claim 1 wherein said article retaining means comprise a plurality of pockets disposed on the inside face of said cover.

9. The organizer notebook of claim 8 wherein at least one of said pockets includes a closure.

10. The organizer notebook of claim 1 wherein said flaps are respectively secured to said top and bottom edge of said other cover and wherein said flaps when in a position overlying said cover terminate at an approximate intermediate location with respect to said cover.

11. The organizer notebook of claim 10 wherein said closure means comprises loop and pile fabric fastener.

* * * * *